United States Patent [19]

Rancon et al.

[11] Patent Number: 5,069,728

[45] Date of Patent: Dec. 3, 1991

[54] PROCESS FOR HEAT TREATING METALS IN A CONTINUOUS OVEN UNDER CONTROLLED ATMOSPHERE

[75] Inventors: Yannick Rancon, Velizy; Eric Duchateau, Versailles, both of France

[73] Assignee: l'Air Liquide, Societe Anonyme Pour l'Etude et l'Exploitation des Procedes Georges Claude, Paris, France

[21] Appl. No.: 543,581

[22] Filed: Jun. 26, 1990

[30] Foreign Application Priority Data

Jun. 30, 1989 [FR] France ..... 89 08786

[51] Int. Cl.[5] ..... C21D 1/74

[52] U.S. Cl. ..... 148/16; 148/16.5; 148/153; 148/157; 266/81

[58] Field of Search ..... 148/16, 16.5, 153, 157; 266/81

[56] References Cited

U.S. PATENT DOCUMENTS

| | | | |
|---|---|---|---|
| 3,492,378 | 1/1970 | Simoncic | 148/16 |
| 3,950,192 | 4/1976 | Golland et al. | 148/16.5 |
| 4,049,472 | 9/1977 | Arndt | 148/16 |
| 4,183,773 | 1/1980 | Kawasoko et al. | 148/16 |
| 4,334,938 | 6/1982 | Shay et al. | 148/16.6 |
| 4,415,379 | 11/1983 | Stenescu et al. | 148/16 |
| 4,531,984 | 7/1985 | Madsac et al. | 148/16 |

FOREIGN PATENT DOCUMENTS

| | | |
|---|---|---|
| 2438687 | 5/1980 | France . |
| 63-310915 | 12/1988 | Japan . |
| 2018299 | 10/1979 | United Kingdom . |

OTHER PUBLICATIONS

"Stealing Nitrogen from the Air", *Advanced Materials & Processes*, vol. 134, No. 3, Sep. 3, 1988, by W. C. Quantz, pp. 100, 102, 104 & 107.

"Heat Treating Processes with Nitrogen and Methanol-Based Atomsphere", *J. Heat Treating*, vol. 2, No. 1, 1981, by M. Kostelitz et al., pp. 35–42.

"Carbon Potential and Composition of a Neutral Controlled Atmosphere Produced from Methane and a Nitrogen-Oxygen Mixture", *Metal Science & Heat Treatment*, vol. 30, Nos. 5–6, May–Jun. 1988, N. A. Titov, pp. 408–414.

*Primary Examiner*—Upendra Roy

*Attorney, Agent, or Firm*—Young & Thompson

[57] ABSTRACT

Heat treating metals by continuous longitudinal passage of metallic pieces in an elongated treating zone under controlled atmosphere having a high temperature upstream end where the controlled atmosphere comprises nitrogen and reducing chemical substances, such as hydrogen, possibly carbon monoxide, and a downstream cooling end under an atmosphere essentially formed by introducing nitrogen. In the high temperature upstream end, the nitrogen which constitutes the atmosphere is supplied by introducing nitrogen with a residual oxygen content not exceeding 5%, the reducing chemical substances being present at any moment in amounts at least sufficient to eliminate oxygen introduced with nitrogen. The nitrogen introduced in the downstream cooling end is substantially free of oxygen. Application of the process to the annealing of metallic pieces.

8 Claims, 1 Drawing Sheet

PROCESS FOR HEAT TREATING METALS IN A CONTINUOUS OVEN UNDER CONTROLLED ATMOSPHERE

BACKGROUND OF INVENTION (a) Field of the Invention

The invention concerns a heat treatment of metals in a continuous oven by continuous longitudinal passage of metallic pieces in an elongated treatment zone under controlled atmosphere having an upstream end at elevated temperature where said controlled atmosphere comprises nitrogen and reducing chemical substances, such as hydrogen, possibly carbon monoxide, and a downstream end under an atmosphere essentially formed by introducing nitrogen.

(b) Description of Prior Art

This type of controlled atmosphere which is essentially utilized for annealing metallic pieces is up to now produced in the following manner:

either by utilizing an exothermic generator which is responsible for the incomplete combustion of a hydrocarbon and air and produces combustion gases which, possibly after purification, contain hydrogen and carbon monoxide in amounts which depend on the air/hydrocarbon ratio introduced into the generator. By way of example, such an exothermic atmosphere may contain 5 to 10% carbon monoxide and 6 to 12% hydrogen;

or there is produced a synthetic atmosphere from pure industrial gases such as nitrogen and hydrogen. The nitrogen is produced by cryogenic distillation of air and contains very little impurities; for example, the total amount of water vapor and oxygen impurities is generally lower than 10 vpm. To this highly pure nitrogen, hydrogen, or a hydrocarbon, or hydrogen and hydrocarbon, or methanol are added so as to produce a reducing atmosphere, which may be non decarburizing, to treat the metallic pieces.

This second procedure has the advantage of completely controlling the treating atmosphere but has the disadvantage of utilizing cryogenic nitrogen which is relatively costly and consequently inadequately adapted for use in generally non-impervious continuous ovens. This is the reason why attempts have been made to reduce the flows of gases introduced by creating for example at the outlet of the cooling zone a nitrogen buffer which enables to prevent any upward introduction of air through the cooling zone thereby ensuring a significant reduction of the global flow of gas introduced. In spite of this important reduction of the global flow, it has been found that the pure industrial gases are still far from being economically attractive as compared to gases which are produced in an exothermic generator.

This is the reason why, in certain applications where this has been found possible, it has been proposed to replace cryogenic nitrogen by nitrogen produced by air separation according to the techniques of adsorption or selective permeation which, under certain conditions of production, substantially reduce costs as compared to cryogenic nitrogen. This procedure is however to the detriment of the oxygen impurities since nitrogen produced by adsorption usually contains a residual amount of 0.5% to 5% oxygen while the residual content of oxygen in nitrogen produced by permeation generally exceeds 3% and may reach up to 10%.

This oxygen impurity makes it very difficult to use raw nitrogen directly to prepare a suitable atmosphere for the heat treatment. In practice, it has been proposed to use nitrogen produced by the selective permeation process only for the production of atmospheres prepared from nitrogen and methanol, as described in the article "Heat treating processes with nitrogen and methanol based atmosphere" M. KOSTELITZ et al., in "Journal of Heat Treating" volume 2, No. 1-35 and in U.S. Pat. No. 4,279,406 and EP-A-0213011. Such an atmosphere prepared from nitrogen having a residual content of oxygen and methanol can indeed be theoretically used for certain applications, namely heating before hardening, carbonitridation and cementation of steel. However, it is only in this last mentioned field of application that nitrogen with a residual amount of oxygen has been used on an industrial basis and this is because of the elevated temperature that is required for cementation, which is of the order of 900° C., this temperature promoting the reaction of residual oxygen carried by nitrogen with the chemical substances of the hydrocarbon type which are simultaneously introduced to constitute the basic atmosphere.

It has been suggested to purify nitrogen with a residual content of oxygen produced by adsorption or permeation, by catalytically reacting oxygen with a corresponding input of hydrogen which is sufficient to lead to the complete elimination of any oxygen, but this process which is relatively costly implies a production cost which is close to that of cryogenic nitrogen, which goes against this method of preparation of pure nitrogen, inasmuch as the production of nitrogen by adsorption or permeation does not have the advantages of flexibility and simplicity as the production of cryogenic nitrogen.

SUMMARY OF INVENTION

The present invention aims at a process for heat treating metals in a continuous oven which enables substantially reducing the cost of the treating atmosphere while providing the required properties of said atmosphere, which should be free of oxygen in the high temperature treating zone as well as in the cooling zone. The process according to the invention is characterized in that, in the high temperature upstream end, the nitrogen which constitutes the atmosphere is supplied by introducing nitrogen with a residual oxygen content not exceeding 5%, preferably higher than 0.5%, which is typically prepared by air separation according to the techniques of permeation or adsorption, and that the reducing chemical substances in said treating atmosphere are present at any moment in amounts at least sufficient to eliminate oxygen introduced with nitrogen, while the nitrogen introduced in the downstream cooling end is substantially free of oxygen.

Thus, in the high temperature zone, by adding or producing in situ sufficient quantities of reducing substances such as hydrogen and carbon monoxide, it is possible to achieve a near instantaneous and near complete elimination of the oxygen introduced with nitrogen by converting same into water vapor and carbon dioxide, while maintaining, if needed, a sufficient amount of said reducing substances so that the $H_2/H_2O$ and $CO/CO_2$ ratios remain within suitable limits to ensure the effect of the required treatment without causing oxidation of the pieces during treatment. On the contrary, in the cooling zone, where the temperature is substantially lower and in any case insufficient to cause an immediate reaction between the residual oxygen carried by nitrogen and the reducing substances which may be present, industrially pure nitrogen is used, i.e. nitrogen which is practically free of oxygen, which however represents only a flow of between 2% and 30% of the total gaseous flow which is introduced into the treating zone. Thus, the introduction of a weak flow of deoxygenated nitrogen in the cool zone of the oven enables to prevent the influx of air and to use less pure nitrogen in the hot zone enabling to reduce the costs of operation without reducing performances.

According to an embodiment, nitrogen introduced in the downstream cooling zone is prepared according to the technique of air separation by cryogenic distillation.

According to another embodiment, nitrogen introduced in the downstream end of the cooling zone is prepared according to the technique of air separation by permeation or adsorption to produce raw nitrogen with a residual content of oxygen, which is eliminated by catalytic reaction with an input of hydrogen in a quantity which is at least sufficient to ensure the elimination of residual oxygen.

BRIEF DESCRIPTION OF THE DRAWING

The single FIGURE of drawing is a side elevational and cross sectional diagrammatic view of apparatus for carrying out a process according to the present invention.

DESCRIPTION OF PREFERRED EMBODIMENTS

Figure 1:
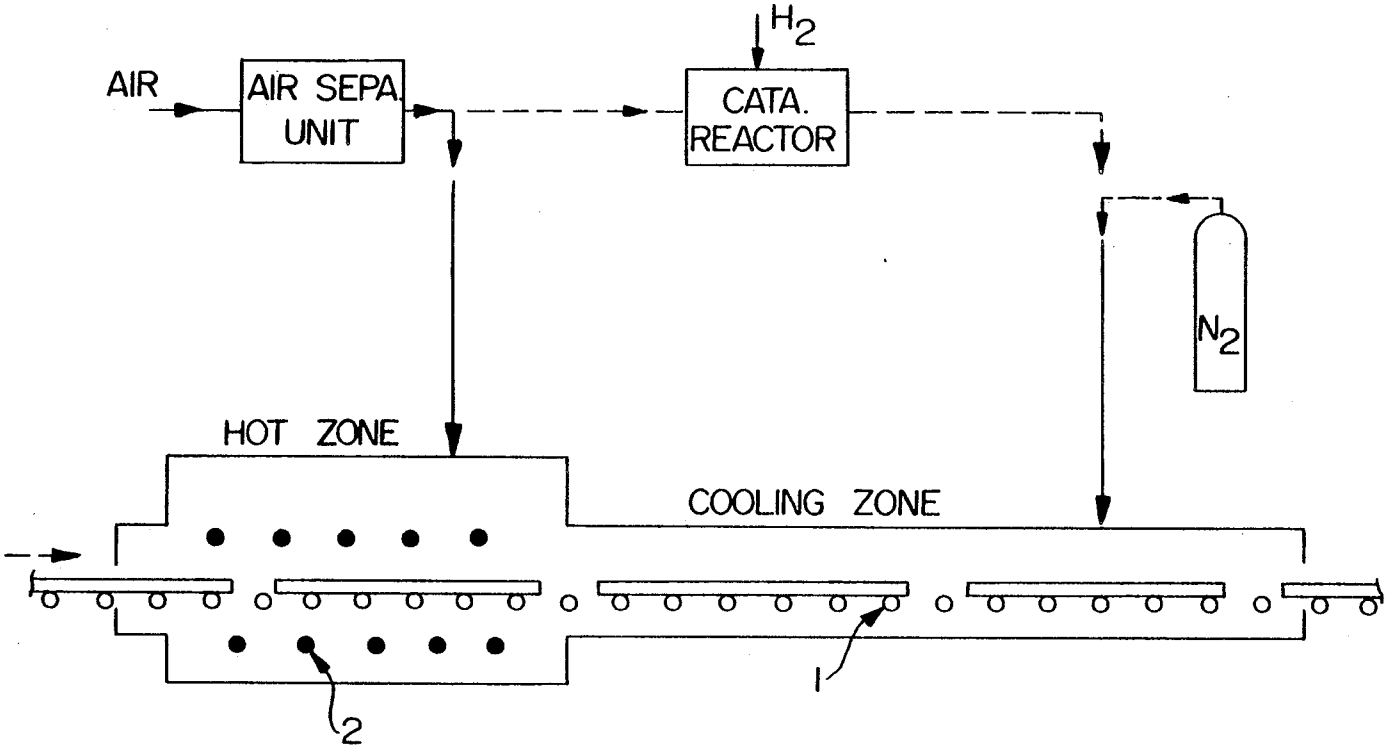

In the accompanying drawing, there is shown a continuous oven having an upstream hot zone and a downstream cooling zone. Metal workpieces are conveyed through the oven in the direction of the arrow, on a roller conveyor 1 and are heated by radiant heating tubes 2 in the hot zone.

The invention will now be illustrated by means of the following examples:

FIRST EXAMPLE

Annealing of steel tubes with low carbon content ($\leqq 0.3\%$)

In a continuous oven constituting an elongated heat treating zone, a total gas flow of 120 $m^3/h$ is introduced, which can be detailed as follows:

there is introduced, at the level of the hot zone, at a temperature of the order of 900° C., 108 $m^3/h$ (90% of total flow) of a mixture consisting of 76 $m^3/h$ of nitrogen with a residual oxygen content of 0.5% and 18.8 l/h of methanol which, by cracking in the oven, gives about 21.3 $m^3/h$ of hydrogen and 10.7 $m^3/h$ of carbon monoxide; the oxygen is immediately combined with the reducing substances to form water vapor and carbon dioxide. Measurements made in the hot zone of the oven have enabled to determine the following contents in the treating atmosphere:

$H_2=19.5\%$
$CO_2=0.3\%$
$CO=9.5\%$
$H_2O=0.6\%$
$O_2<5$ vpm

The $H_2/H_2O$ and $CO/CO_2$ ratios are such that the treating atmosphere is not oxidizing towards the metal.

at the downstream end of the cooling zone, 12 $m^3/h$ (10% of total flow) consisting of nitrogen produced by cryogenic distillation with an oxygen content lower than 10 vpm are introduced in order to prevent any introduction of air.

SECOND EXAMPLE decarburizing annealing of magnetic sheet iron

Such an annealing is carried out here in a continuous oven at a temperature of the order of 800° C.

A total flow of 100 $m^3/h$ is introduced into the oven, said flow being detailed as follows:

at the level of the hot zone, there are introduced 85 $m^3/h$ (85% of the total flow) of a mixture consisting of 68 $m^3/h$ of nitrogen with a residual content of oxygen of 3% and 10 liter/hour of methanol which, by cracking in the oven, produce about 11.3 $m^3/h$ of hydrogen and 5.7 $m^3/h$ of carbon monoxide. The residual oxygen is immediately combined with the reducing substances to form water vapor and carbon dioxide which are the decarburizing agents of the magnetic sheet irons. Measurements made at the level of the hot zone of the oven have permitted to establish that the water vapor content is sufficient to ensure a decarburization of the metal and that the $H_2/H_2O$ and $CO/CO_2$ ratios remain sufficient to protect the metal against any oxidation in the hot zone, which would interfere with the decarburization.

Values measured:

$H_2=9.5\%$
$CO=5.0\%$
$H_2=3.5\%$
$CO_2=1.5\%$
$O_2<5$ vpm

15 $m^3/h$ (15% of total flow) of cryogenic nitrogen are introduced at the level of the cooling zone, which enables to give decarburizing annealing without burning. The fact of utilizing cryogenic nitrogen prevents any oxidation of the iron constituting the magnetic sheet irons, cryogenic nitrogen essentially acting to form a buffer at the outlet of the oven.

Possibly, water vapor may be added in the cooling zone to produce, on the contrary, a burning of the pieces.

THIRD EXAMPLE

Annealing of copper tubes

The annealing of copper tubes is here carried out in a continuous oven at a temperature of the order of 650° C.

A total flow of 180$m^3/h$ is introduced into the oven, which flow is detailed as follows:

in the hot zone, 170 $m^3/h$ (95% of total flow) of a mixture consisting of 165 $m^3/h$ of nitrogen with a residual oxygen content of 0.5% and 5 $m^3/h$ of hydrogen are added. By reaction with the oxygen of the oven, about 1.7 $m^3/h$ of water vapor is formed, while there still remain about 3.3 $m^3/h$ of hydrogen. In this manner, the oxygen is removed nearly instantaneously in order not to oxidize the copper. The presence of water vapor has no bad effect bearing in mind the content of hydrogen.

10 $m^3/h$ (5% of total flow) of a mixture of nitrogen, water vapor and hydrogen, obtained by adding to raw nitrogen, produced by permeation or adsorption presenting a residual content of oxygen of 0.5%, hydrogen in an amount which is at least sufficient to ensure the elimination of oxygen by catalytic reaction, are added to the cooling zone.

FOURTH EXAMPLE

Annealing of bronze pieces at 500° C.

Conditions identical to those of example 3 are used.

We claim:

1. A process for heat treating metal, comprising continuously conveying the metal through an elongated treatment chamber having a first upstream heating zone and a second downstream cooling zone, continuously introducing from outside said chamber into said first zone a gas consisting essentially of nitrogen containing between 0.5 to 5% of oxygen plus reducing gas in an amount at least sufficient to react with and eliminate said oxygen, and continuously introducing from outside said chamber into said second zone a gas consisting essentially of nitrogen which is substantially oxygen-free.

2. A process as claimed in claim 1, in which said gas introduced into said second zone comprises between 2% and 30% of the total gas introduced into said chamber.

3. A process as claimed in claim 1, in which said reducing gas is methanol.

4. A process as claimed in claim 1, wherein said metal is copper or bronze and is subjected to annealing in said chamber, said reducing gas comprising at least hydrogen and the temperature of said first zone being between 350° and 700° C.

5. A process as claimed in claim 1, wherein the oxygen-containing nitrogen is obtained from air separation by permeation or adsorption.

6. A process as claimed in claim 1, wherein the substantially oxygen-free nitrogen is obtained from air separation by cryogenic distillation.

7. A process as claimed in claim 1, wherein the substantially oxygen-free nitrogen is obtained from air separation by permeation or adsorption and is purified by catalytic reaction with hydrogen.

8. A process as claimed in claim 3, wherein said metal is magnetic and is subjected to decarburizing annealing in said first zone, said methanol being introduced at a rate to produce sufficient $H_2O$ and $CO_2$ for decarburization of said magnetic metal.

* * * * *